US010022034B2

(12) United States Patent
Hofmann et al.

(10) Patent No.: US 10,022,034 B2
(45) Date of Patent: Jul. 17, 2018

(54) DISHWASHER APPLIANCE AND METHOD

(71) Applicant: Haier US Appliance Solutions, Inc., Wilmington, DE (US)

(72) Inventors: Adam Christopher Hofmann, Louisville, KY (US); Matthew D. Mersch, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 187 days.

(21) Appl. No.: 15/207,547

(22) Filed: Jul. 12, 2016

(65) Prior Publication Data

US 2018/0014713 A1 Jan. 18, 2018

(51) Int. Cl.

| | |
|---|---|
| ***B08B 7/04*** | (2006.01) |
| ***A47L 15/00*** | (2006.01) |
| ***A47L 15/42*** | (2006.01) |
| ***A47L 15/50*** | (2006.01) |
| ***A47L 15/23*** | (2006.01) |

(52) U.S. Cl.

CPC ..... *A47L 15/0039* (2013.01); *A47L 15/001* (2013.01); *A47L 15/0015* (2013.01); *A47L 15/23* (2013.01); *A47L 15/4204* (2013.01); *A47L 15/4206* (2013.01); *A47L 15/4259* (2013.01); *A47L 15/4261* (2013.01); *A47L 15/4297* (2013.01); *A47L 15/502* (2013.01); *A47L 15/507* (2013.01); *A47L 2401/10* (2013.01); *A47L 2501/05* (2013.01)

(58) Field of Classification Search

CPC ..... A47L 15/0039; A47L 15/001; A47L 15/0015; A47L 15/23; A47L 15/4204; A47L 15/4206; A47L 15/4259; A47L 15/4261; A47L 15/4297; A47L 15/502; A47L 15/507; A47L 2401/10; A47L 2501/05

See application file for complete search history.

(56) References Cited

U.S. PATENT DOCUMENTS

| | | | | |
|---|---|---|---|---|
| 5,097,855 | A | 3/1992 | Martinsson et al. | |
| 5,909,743 | A * | 6/1999 | Thies | A47L 15/0049 134/10 |
| 6,698,438 | B2 | 3/2004 | Hegeman et al. | |
| 8,197,608 | B2 | 6/2012 | Beer et al. | |
| 8,882,928 | B2 | 11/2014 | Kim et al. | |
| 9,339,166 | B2 * | 5/2016 | Thiyagarajan | A47L 15/4208 |

(Continued)

*Primary Examiner* — Sharidan Carrillo

(74) *Attorney, Agent, or Firm* — Dority & Manning, P.A.

(57) ABSTRACT

A dishwasher appliance and method of operation is provided. The dishwasher appliance may include a tub defining a wash chamber, a coarse filter disposed, a recirculation pump, and a drain pump. The method may include activating the recirculation pump to flow wash fluid through the coarse filter in a primary flow direction, and activating the drain pump to flow wash fluid through the coarse filter in the primary flow direction for an initial purge cycle. Further included may be flushing wash fluid through the coarse filter and into the tub in a secondary flow direction opposite from the primary flow direction. Still further included may be activating the recirculation pump to flow wash fluid through the coarse filter in the primary flow direction, and activating the drain pump to flow wash fluid through the coarse filter in the primary flow direction for an additional purge cycle.

20 Claims, 8 Drawing Sheets

(56) References Cited

U.S. PATENT DOCUMENTS

| | | | | |
|---|---|---|---|---|
| 2004/0173245 | A1* | 9/2004 | Elick | A47L 15/4204 134/25.2 |
| 2009/0283111 | A1* | 11/2009 | Classen | A47L 15/4206 134/10 |
| 2012/0048300 | A1* | 3/2012 | Thiyagarajan | A47L 15/4202 134/10 |
| 2012/0222705 | A1 | 9/2012 | Steiner et al. | |
| 2012/0291821 | A1* | 11/2012 | Buddharaju | A47L 15/4208 134/109 |
| 2015/0201824 | A1* | 7/2015 | Thiyagarajan | A47L 15/4208 134/10 |
| 2018/0014713 | A1* | 1/2018 | Hofmann | A47L 15/0039 |

* cited by examiner

DISHWASHER APPLIANCE AND METHOD

FIELD OF THE INVENTION

The present subject matter relates generally to methods of operating dishwasher appliances, and more particularly to methods of controlling the flow of wash fluid across one or more filters in dishwasher appliances.

BACKGROUND OF THE INVENTION

Dishwasher appliances generally include a tub that defines a wash chamber. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber. Other configurations may be used as well.

Some dishwasher appliances further include a fluid circulation system that is in fluid communication with the spray assemblies for circulating fluid to the spray assemblies. The fluid circulation system generally receives fluid from the wash chamber, filters soil from the fluid, and flows the filtered fluid either to the spray assemblies or to a drain. To facilitate the flow of filtered fluid to the spray assemblies and/or drain, a pump is typically included in the fluid circulation system.

However, in some existing dishwasher appliances, one or more portions of the appliance may become undesirably clogged or impeded, as when debris or particles accumulate on a filter. This clogging may hinder performance of the dishwasher appliance. For instance, additional water may be needed to complete certain wash cycles. Moreover, if debris is not adequately removed, it may be redeposited onto items within the dishwasher appliance (e.g., dishes), undercutting cleaning performance of the appliance.

Accordingly, further developments may be desirable for operating dishwasher appliances. Moreover, it would be advantageous if further developments addressed one or more of the above issues.

BRIEF DESCRIPTION OF THE INVENTION

Aspects and advantages of the invention will be set forth in part in the following description, or may be obvious from the description, or may be learned through practice of the invention.

In one aspect of the present disclosure a method of operating a dishwasher appliance is provided. The dishwasher appliance may include a tub defining a wash chamber, a coarse filter disposed at a bottom portion of the tub, a recirculation pump downstream from the coarse filter in a primary flow direction, and a drain pump downstream from the coarse filter in the primary flow direction. The method may include activating the recirculation pump to flow wash fluid through the coarse filter in the primary flow direction for an initial purge cycle, and activating the drain pump to flow wash fluid through the coarse filter in the primary flow direction for the initial purge cycle. Further included may be flushing wash fluid through the coarse filter and into the tub in a secondary flow direction, the secondary flow direction being opposite from the primary flow direction. The method may still further include activating the recirculation pump to flow wash fluid through the coarse filter in the primary flow direction for an additional purge cycle, and activating the drain pump to flow wash fluid through the coarse filter in the primary flow direction for the additional purge cycle.

In another aspect of the present disclosure, a method of operating a dishwasher appliance is provided. The dishwasher appliance may include a tub defining a wash chamber, a coarse filter disposed at a bottom portion of the tub, a recirculation pump downstream from the coarse filter in a primary flow direction, and a drain pump downstream from the coarse filter in the primary flow direction. The method may include directing wash fluid to the wash chamber within the appliance. The method may also include activating the recirculation pump to flow wash fluid through the coarse filter in the primary flow direction for an initial purge cycle, and activating the drain pump to flow wash fluid through the coarse filter in the primary flow direction for the initial purge cycle. Further included may be flushing wash fluid through the coarse filter and into the wash chamber in a secondary flow direction from the spray assembly, the secondary flow direction being opposite from the primary flow direction. Still further included may be activating the recirculation pump to flow wash fluid through the coarse filter in the primary flow direction for an additional purge cycle, and activating the drain pump to flow wash fluid through the coarse filter in the primary flow direction for the additional purge cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
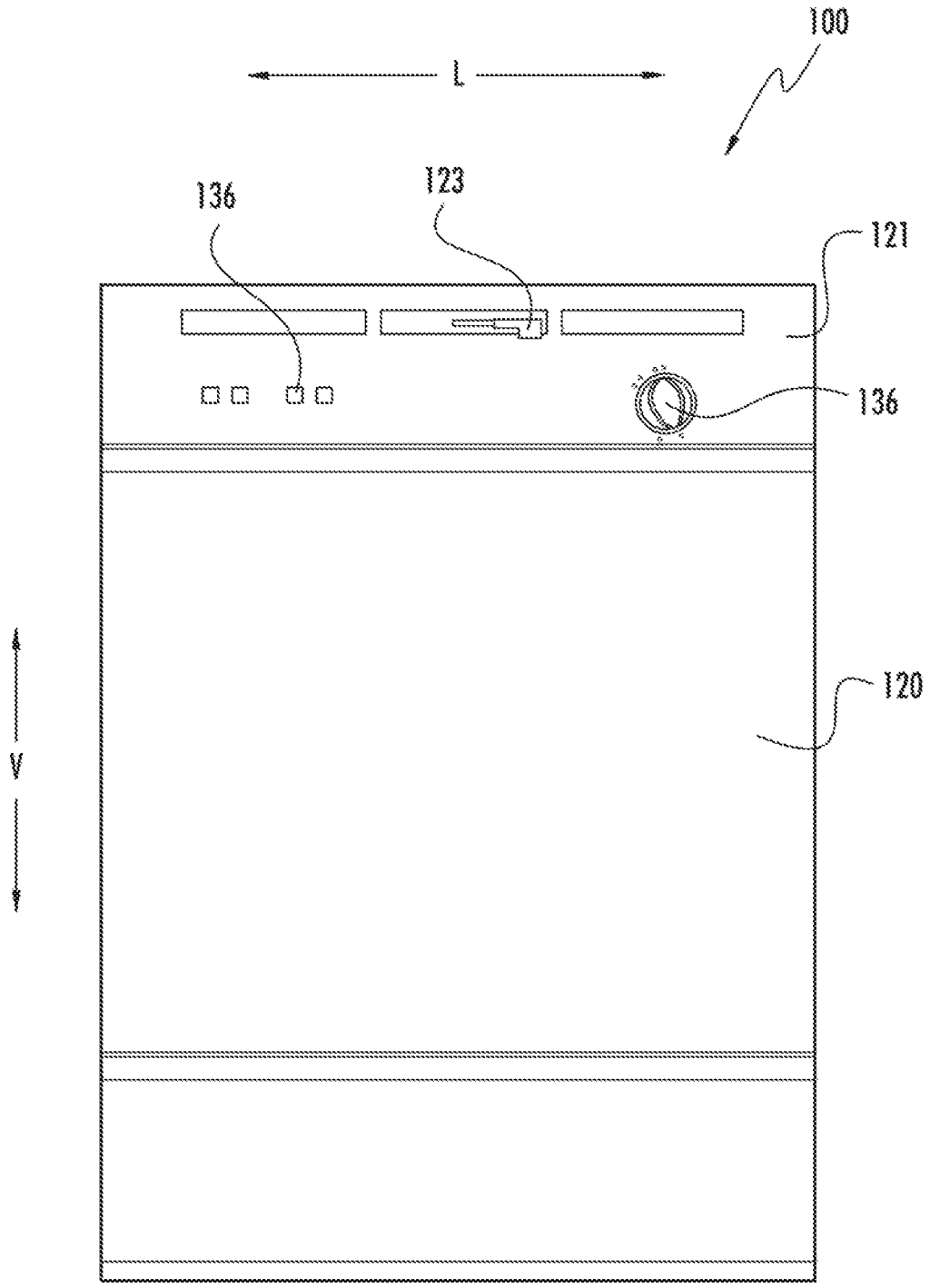
FIG. 1 provides a front view of a dishwasher appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure may provide a method of operating a dishwasher appliance that reduces the build-up or accumulation of debris or particles on a coarse filter above a sump portion of an internal wash chamber. In some exemplary embodiments, the present disclosure may provide for operating multiple discrete pumps to suck wash fluid and debris through the coarse filter. After one cycle ends, the pumps may be stopped for another cycle as wash fluid is directed to the sump portion. Eventually, water may overflow from the sump portion of the wash chamber. The overflowing wash fluid may rise above the coarse filter, lifting debris that has accumulated on the coarse filter. After the debris has been lifted from the coarse filter, both pumps may be operated to again suck wash fluid and debris through the coarse filter. Eventually, one pump may be stopped and the remaining wash fluid and debris may be drained via the other pump.

Figure 2:
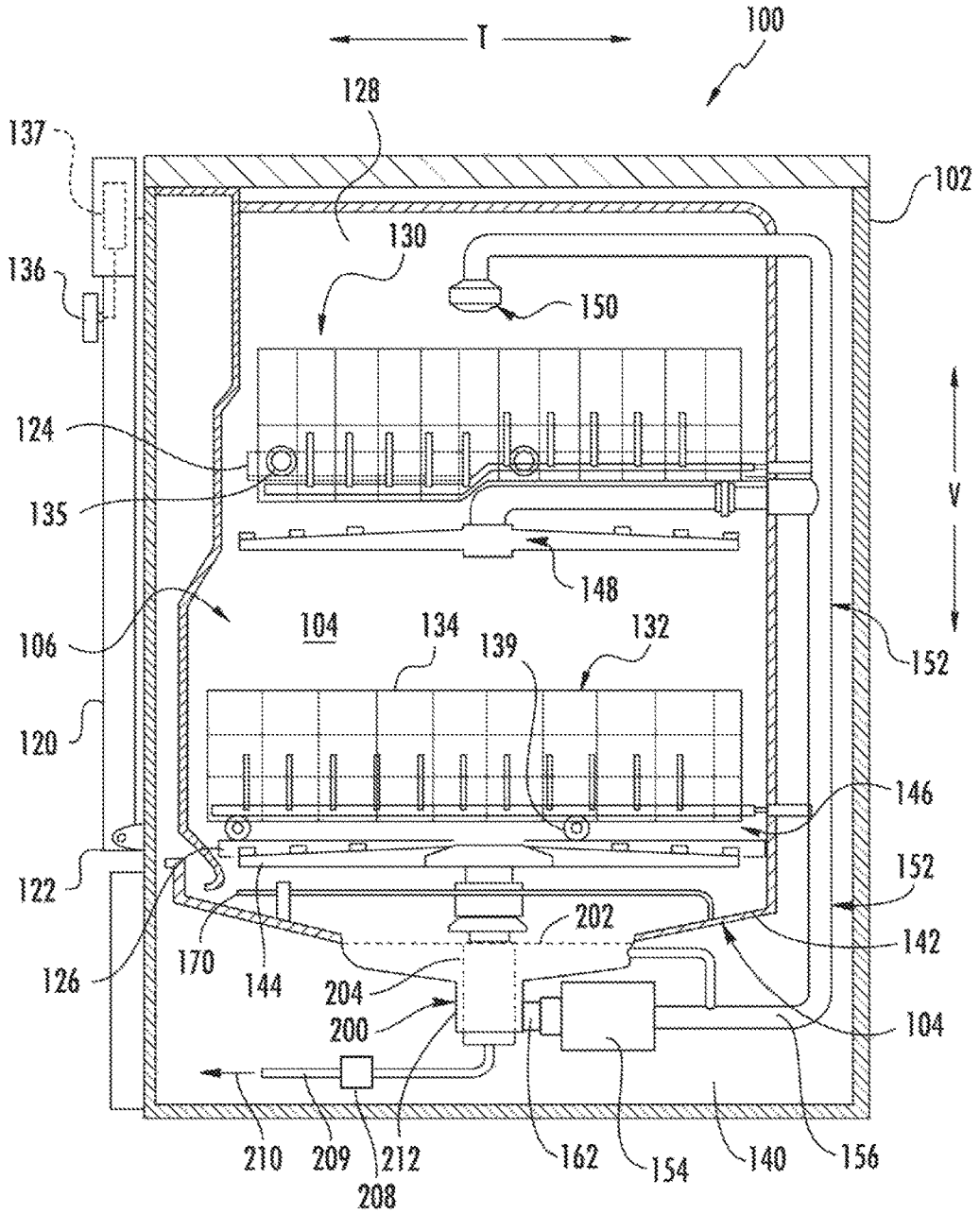
FIG. 2 provides a side view of a dishwasher appliance according to an exemplary embodiment of the present disclosure.
Figure 3:
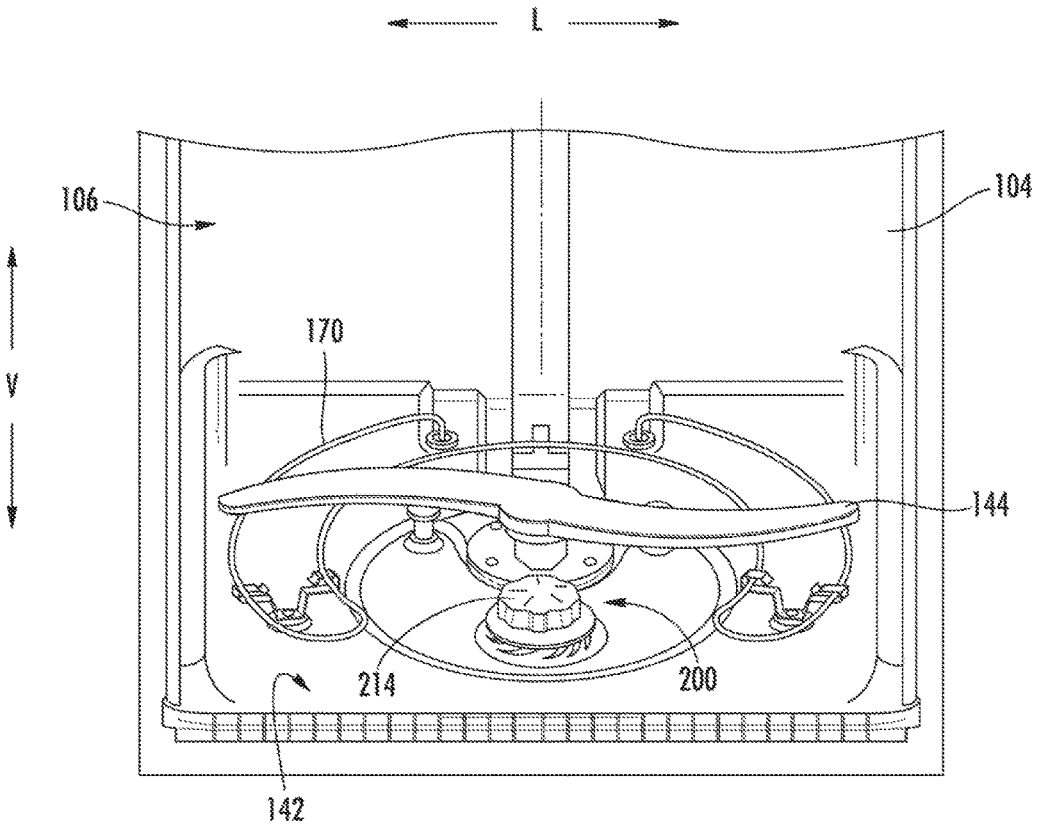
FIG. 3 provides a front perspective view an internal portion of the exemplary dishwasher appliance of FIG. 2.

FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operations, and a horizontal open position for loading and unloading of articles from the dishwasher. Latch 123 is used to lock and unlock door 120 for access to wash chamber 106.

Upper and lower guide rails 124, 126 are mounted on tub side walls 128 and accommodate roller-equipped rack assemblies 130 and 132. In optional embodiments, each of the rack assemblies 130, 132 is fabricated into lattice structures including a plurality of elongated members 134 (for clarity of illustration, not all elongated members forming assemblies 130 and 132 are shown in FIG. 2). Each rack 130, 132 is adapted for movement between an extended loading position (not shown), in which the rack is substantially positioned outside the wash chamber 106, and a retracted position (shown in FIGS. 1 and 2), in which the rack is located inside the wash chamber 106. This rack movement is facilitated by rollers 135 and 139, for example, mounted onto racks 130 and 132, respectively. A silverware basket (not shown) may be removably attached to rack assembly 132 for placement of silverware, utensils, and the like that are otherwise too small to be accommodated by the racks 130, 132.

The dishwasher appliance 100 further includes a lower spray-arm assembly 144 that is rotatably mounted within a lower region 146 of the wash chamber 106 and above a tub sump portion 142 so as to rotate in relatively close proximity to rack assembly 132. In exemplary embodiments, such as the embodiment of FIGS. 1 and 2, one or more elevated spray assemblies 148, 150 are provided above the lower spray-arm assembly 144. For instance, a mid-level spray-arm assembly 148 is located in an upper region of the wash chamber 106 and may be located in close proximity to upper rack 130. Additionally or alternatively, an upper spray assembly 150 may be located above the upper rack 130.

The lower and mid-level spray-arm assemblies 144, 148 and the upper spray assembly 150 are part of a fluid circulation assembly 152 for circulating a wash fluid, such as water and/or dishwasher fluid, in the tub 104. The fluid circulation assembly 152 also includes a recirculation pump 154 positioned in a machinery compartment 140 located below the tub sump portion 142 (i.e., below a bottom wall) of the tub 104, as generally recognized in the art. The recirculation pump 154 receives fluid from sump 142 to provide a flow to assembly 152, or optionally, a switching valve or diverter (not shown) may be used to select flow. A heating element 170 can be used to provide heat during e.g., a drying cycle.

Each spray-arm assembly 144, 148 includes an arrangement of discharge ports or orifices for directing washing fluid received from the recirculation pump 154 onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of the spray assembly 150 using fluid from the recirculation pump 154 provides coverage of dishes and other dishwasher contents with a washing spray. Other configurations of spray assemblies may be used as well.

In some embodiments, the dishwasher appliance 100 is further equipped with a controller 137 to regulate operation of the dishwasher appliance 100. The controller may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. For certain embodiments, the instructions include a software package configured to operate appliance 100 and, e.g., execute the exemplary methods 300 and/or 400 described below with reference to FIGS. 8 and 9. The memory may be a separate component from the processor or may be included onboard within the processor. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 137 may be positioned in a variety of locations throughout dishwasher appliance 100. In the illustrated embodiment, the controller 137 may be located within a control panel area 121 of door 120 as shown in FIGS. 1 and 2. In some such embodiments, input/output ("I/O") signals may be routed between the control system and various operational components of dishwasher appliance 100 along one or more wiring harnesses that may be routed through the bottom 122 of door 120. Optionally, the controller 137 includes a user interface panel/controls 136 through which a user may select various operational features and modes and monitor progress of the dishwasher appliance 100. In exemplary embodiments, the user interface 136 may represent a general purpose I/O ("GPIO") device or functional block. For instance, the user interface 136 may include input components, such as one or more of a variety of electrical, mechanical, or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, and other differences may be applied as well.

Figure 4:
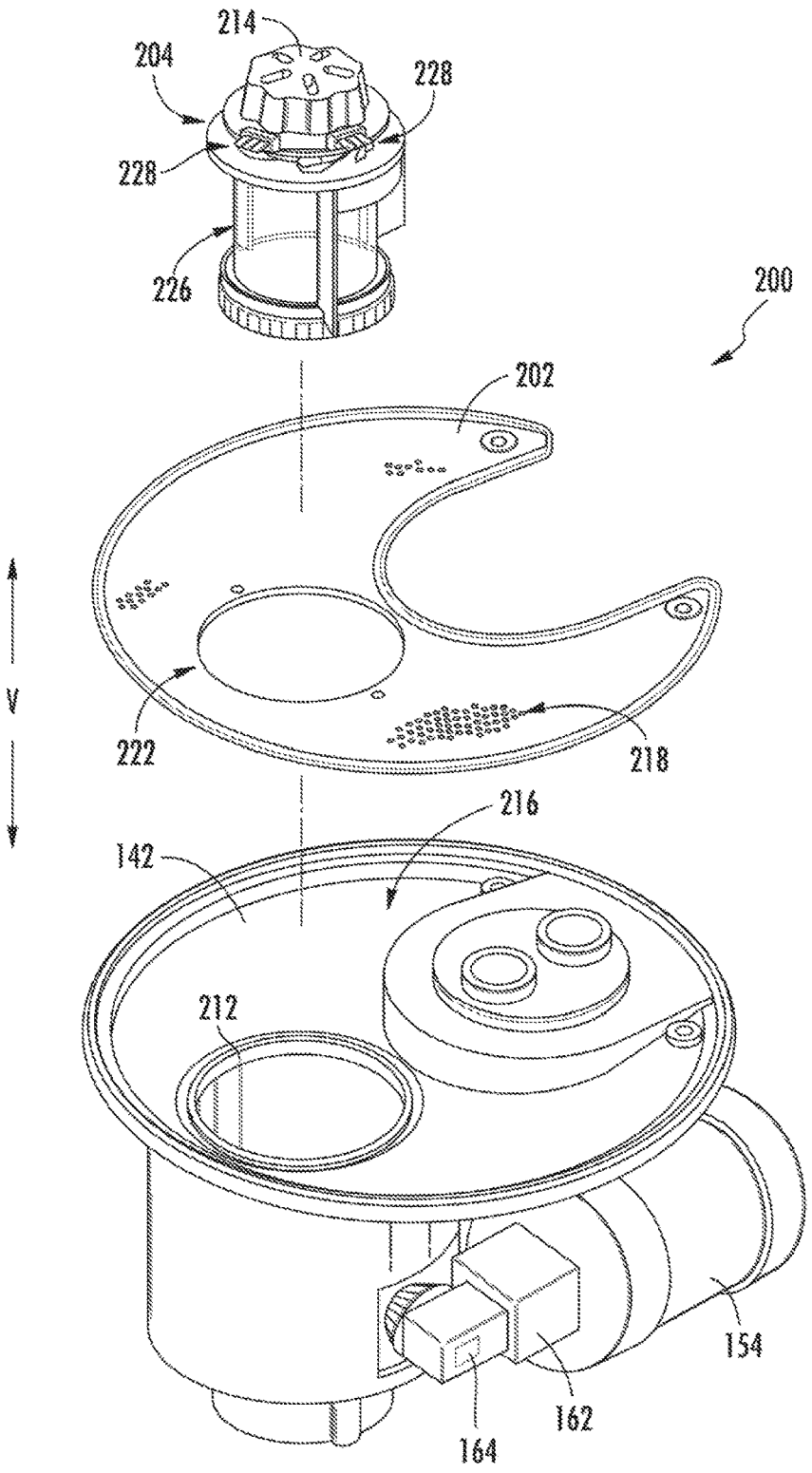
FIG. 4 provides an exploded view of a portion of the filter system of the exemplary dishwasher appliance of FIG. 2.

Referring now to FIGS. 2, through 4, an exemplary filtering system 200 is provided. As shown, in exemplary embodiments, filtering system 200 is located in sump portion 142 and provides filtered fluid to pump inlet 162. Generally, filtering system 200 removes soiled particles from the fluid that is recirculated through the wash chamber 106 during operation of dishwasher appliance 100. In exemplary embodiments, filtering system 200 includes both a first filter 202 (also referred to as a "coarse filter") and a second filter 204 (also referred to as a "fine filter").

In some embodiments, coarse filter 202 is constructed as a grate having openings 218 for filtering fluid received from wash chamber 106. Sump portion 142 includes a recessed portion 216 over which coarse filter 202 is removably received. In one exemplary embodiment, coarse filter 202 operates as a coarse filter having media openings 218 in the range of about 0.030 inches to about 0.060 inches. Recessed portion 216 may define a filtered volume wherein debris or particles have been filtered by coarse filter 202 and/or fine filter 204. As shown, pump inlet 162 is defined within recessed portion 216. A recirculation conduit 156 may be disposed in fluid communication with the pump inlet 162 and the recirculation pump 154. During certain operations, wash fluid may be selectively motivated, e.g., by the recirculation pump, to flow through pump inlet 162 and recirculation conduit 156 before being motivated to one or more of lower spray arm assembly 144, mid-level spray-arm assembly 148, or upper spray assembly 150.

Fine filter 204 may be non-removable or can be provided as a removable cartridge positioned in a cylindrically-shaped receptacle 212 formed in sump portion 142. For instance, fine filter 204 may include a cylindrical wall 226 formed from one or more fine filter media. Some such embodiments may include filter media, e.g., screen or mesh, having pore or hole sizes in the range of about 50 microns to about 600 microns. As illustrated, cylindrical wall 226 may define an internal chamber 224. A top portion 214 of fine filter positioned above internal chamber 224 may define one or more openings 228 permitting fluid to flow into internal chamber 224 without passing through coarse filter 202 or the fine filter media of cylindrical wall 226. Top portion 214 may include a handle that allows a user to grasp and remove fine filter 204 for replacement or cleaning. An opening 222 defined through coarse filter 202 allows for positioning of fine filter 204 into receptacle 212.

Between openings 228 and drain pump 208, internal chamber 224 defines an unfiltered volume. An exit conduit 209 may be positioned downstream from drain pump 208 in fluid communication with internal chamber 224. As illustrated, exit conduit 209 may extend to a drain outlet 210. During certain operations, debris or particles may pass through openings 228 and into internal chamber 224. When drain pump 208 is activated, fluid and/or particles within internal chamber 224 may be directed through exit conduit 209 and drain outlet 210, flowing wash fluid to an area outside of appliance 100, e.g., an ambient area.

Based on the shape of sump portion 142 (see FIG. 2), during certain operations, e.g., washing or cleaning cycles, fluid flows down along a primary flow direction, e.g., in fluid series from the wash chamber 106 to the recessed portion 216, for filtration in the filtering system 200. After the fluid is filtered by passing through coarse filter 202 or fine filter 204, e.g., downstream along in the primary direction, the filtered fluid is fed to the inlet 162 of the recirculation pump 154 for return to the wash chamber 106 by way of fluid circulation assembly 152. Optionally, one or more sensors 164, e.g., turbidity sensors, may be disposed within fluid circulation assembly 152, e.g., at pump inlet 162, for monitoring a condition of recirculated fluid during operations. After being sprayed onto articles in the dishwasher appliance 100 using one or more of the spray elements 144, 148, and 150, the wash fluid eventually flows to sump portion 142 and is filtered again.

Filtered waste material, such as debris or particles dislodged from items in the appliance 100, can be removed from filtering system 200 by a drain pump 208 feeding drain outlet 210. Accordingly, filtering system 200 acts to clean soil particles from the fluid so as to e.g., protect the recirculation pump 154 and/or the spray assemblies from clogging as the fluid is recirculated during some operations of the dishwasher appliance 100 such as e.g., a wash or cleaning cycle of appliance 100. The filtering system 200 can also provide a cleaner fluid during the cleaning process, which may result in cleaner articles.

Figure 5:
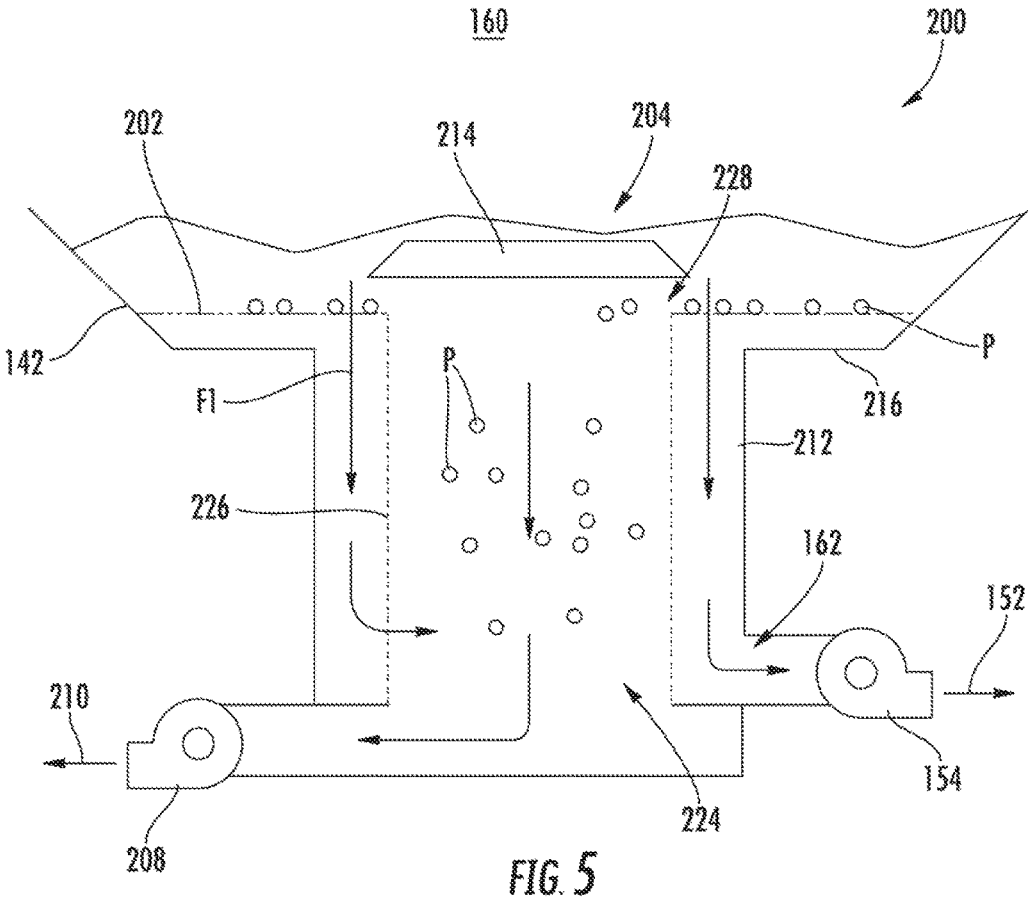
FIG. 5 provides a schematic view of a sump and filter assembly according to an exemplary embodiment of the present disclosure during one operation cycle.
Figure 6:
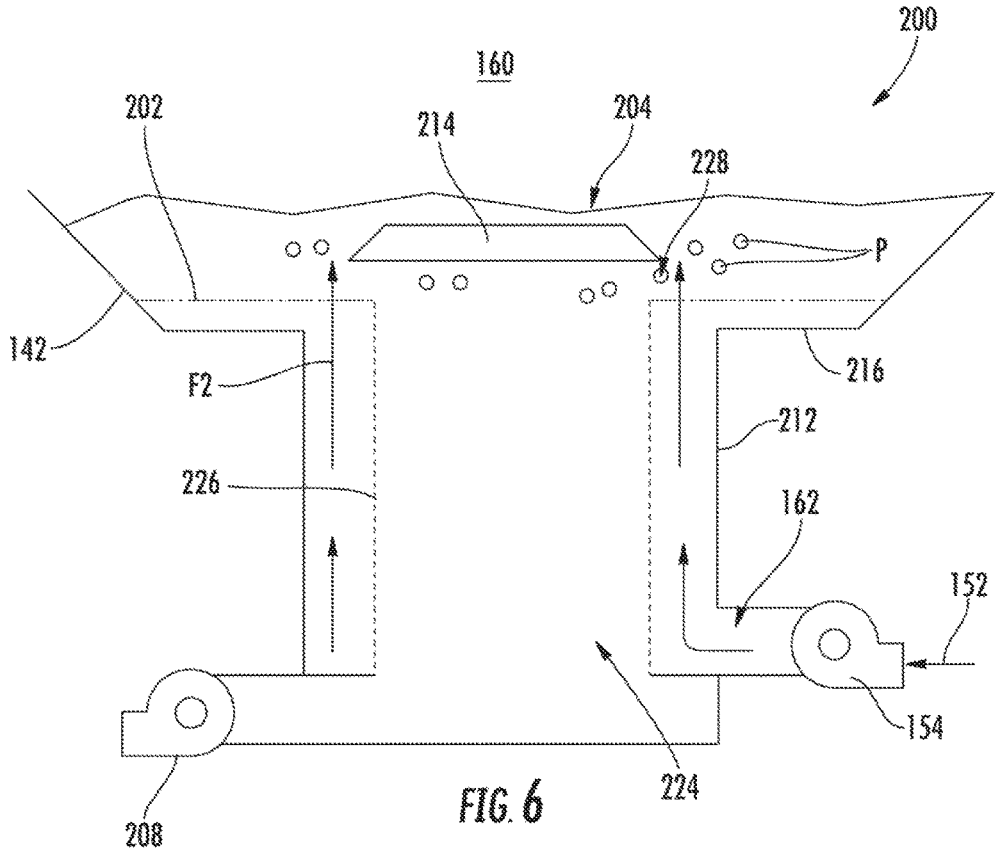
FIG. 6 provides a schematic view of a sump and filter assembly according to the exemplary embodiment of FIG. 5 during another operation cycle.
Figure 7:
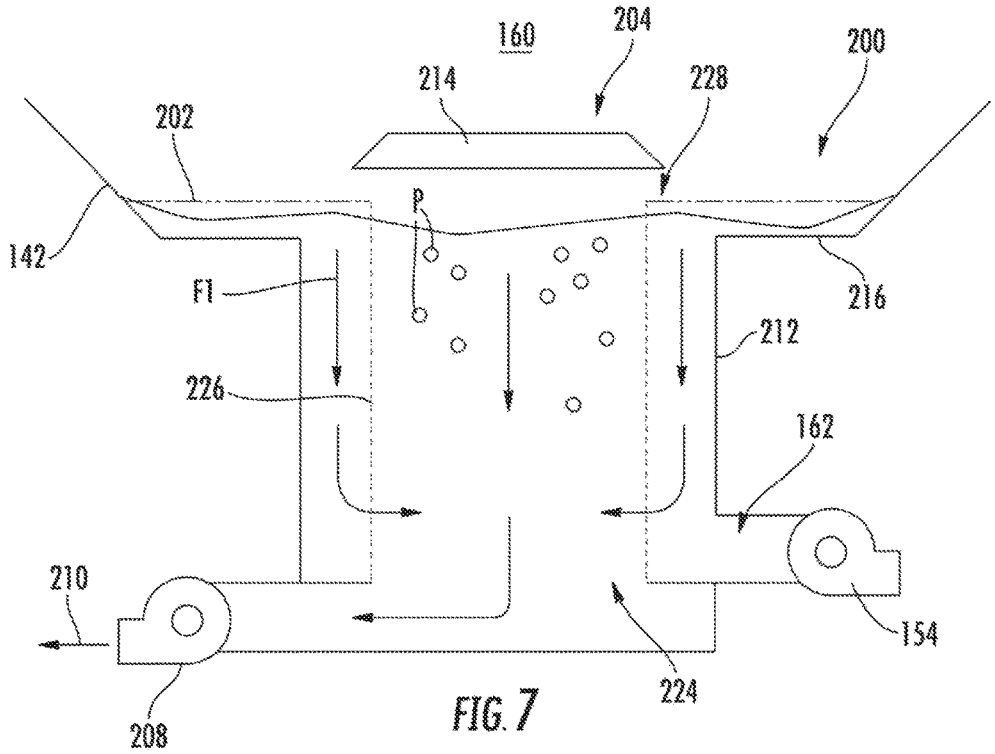
FIG. 7 provides a schematic view of a sump and filter assembly according to an exemplary embodiment of FIG. 5 during yet another operation cycle.

Turning to FIGS. 5 through 7, various appliance operation cycles are illustrated, e.g., for removing debris or particles P caught by the coarse filter 202. As shown in FIG. 5, an initial purge cycle may be provided in some embodiments. During the initial purge cycle, the drain pump 208 may be activated. The drain pump 208 may force wash fluid to flow along the primary flow direction F1, e.g., through the coarse filter 202 and/or into the internal chamber 224. At least a portion of wash fluid may be directed into the exit conduit 209 (see FIG. 2) and to the drain outlet 210. Debris or particles P within the internal chamber 224 may also be directed into the exit conduit 209 and to the drain outlet 210. In some embodiments, the recirculation pump 154 may be activated during the initial purge cycle. Activation of the recirculation pump 154 may be simultaneous to the activation of the drain pump 208. The recirculation pump 154 may force wash fluid to flow along the primary flow direction F1, e.g., through coarse filter 202 and/or into internal chamber 224. At least a portion of wash fluid may be directed to the fluid circulation assembly 152 through the pump inlet 162. A portion of debris or particles P may become lodged on a top portion of the coarse filter 202, e.g., a portion facing wash chamber 106 and away from recessed portion 216.

As shown in FIG. 6, a rinsing cycle may follow the initial purge cycle in some embodiments. Generally, the rinsing cycle provides for wash fluid flowing in a secondary flow direction F2, e.g., a flow direction opposite to the primary flow direction F1. For instance, wash fluid may flow through the coarse filter 202 and into the tub 104 from the recirculation conduit 156 (see FIG. 2). In exemplary embodiments, wash fluid flow is reversed and wash fluid descends through fluid circulation assembly 152 from one or more of the spray assemblies 144, 148, 150 (see FIG. 2). Conduits of the fluid circulation assembly 152 directed to the mid-level spray arm assembly 148 and/or upper assembly 150 may contain a volume of wash fluid sufficient to fill and exceed, i.e., overflow, the capacity of the recessed portion 216. In some embodiments, the drain pump 208 is halted, e.g., disengaged, during the rinsing cycle. Optionally, the recirculation pump 154 may also be halted, e.g., disengaged. As shown, particles P lodged or disposed on coarse filter 202 may be dislodged or lifted upward in the vertical direction V away from coarse filter 202. Particles P may flow with wash fluid in the secondary flow direction F2 into tub 104.

Similar to the initial purge cycle of FIG. 5, one or more additional purge cycles may follow the rinsing cycle in some embodiments. During the additional purge cycle, the drain pump 208 may be activated. The drain pump 208 may force wash fluid to flow along the primary flow direction F1, e.g., through the coarse filter 202 and/or into the internal chamber 224. At least a portion of wash fluid may be directed into the exit conduit 209 (see FIG. 2) and to the drain outlet 210. Debris or particles P within the internal chamber 224 may also be directed into the exit conduit 209 and to the drain outlet 210. In some embodiments, the recirculation pump 154 is also activated during the additional purge cycle, e.g., simultaneously with the drain pump 208. The recirculation pump 154 may force wash fluid to flow along the primary flow direction F1, e.g., through coarse filter 202 and/or into internal chamber 224. At least a portion of wash fluid may be directed to the fluid circulation assembly 152 through the pump inlet 162.

As shown in FIG. 7, in some embodiments, a drain cycle may be provided, e.g., following one or more purge cycles and/or rinsing cycles. For example, after an additional purge cycle, the drain pump 208 may activated during drain cycle. As illustrated, the drain pump 208 may force wash fluid to flow along the primary flow direction F1, e.g., through coarse filter 202 and/or into internal chamber 224. All or some of the wash fluid within the tub 104 may be directed into exit conduit 209 (see FIG. 2) and to the drain outlet 210. Particles within internal chamber 224 may also be directed into the exit conduit 209 and to the drain outlet 210. Moreover, the recirculation pump 154 may be halted, e.g., deactivated, for the drain cycle.

It is envisioned that the steps above may occur independently of and/or during a wash cycle, such as a pre-wash cycle or a main wash cycle. Alternatively, the steps above may be operatively linked to a predetermined wash cycle. For instance, the steps may be provided immediately following a main wash cycle. Additionally or alternatively, the steps may be provided immediately following a pre-wash cycle, e.g., prior to a main wash cycle.

Figure 8:
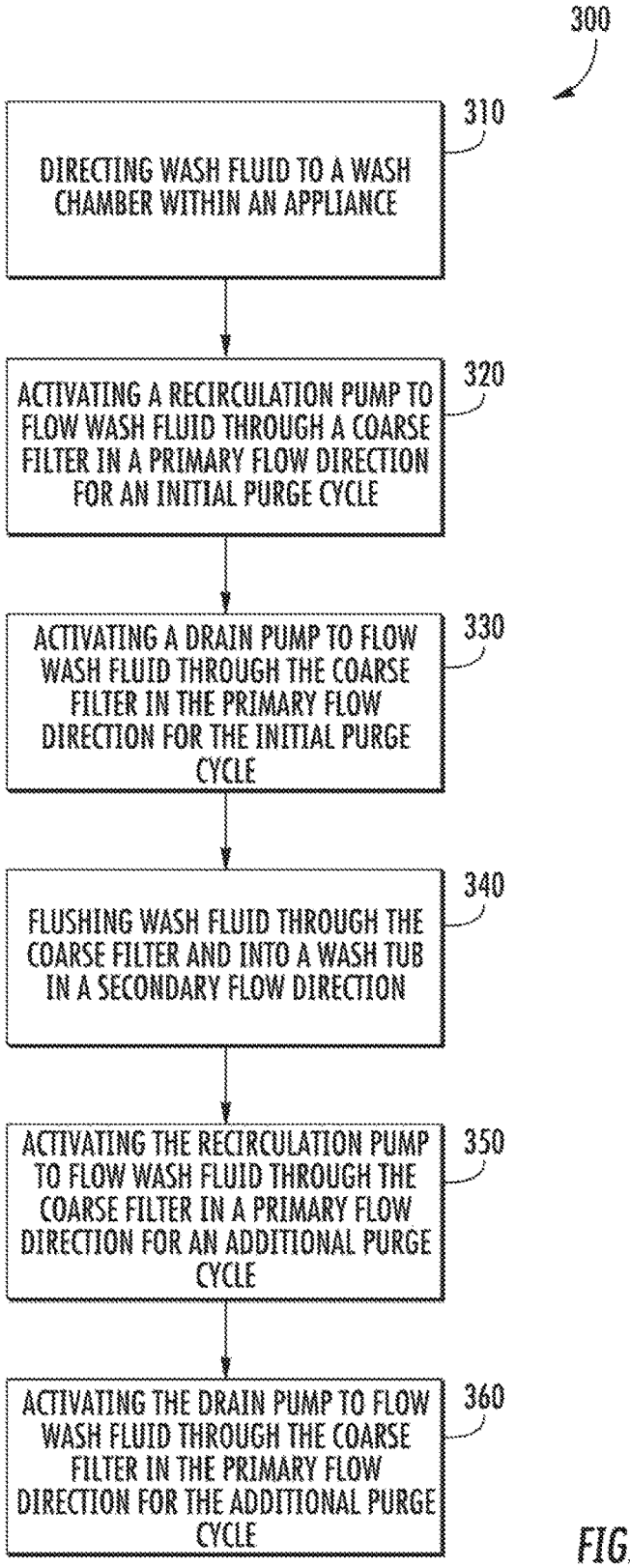
FIG. 8 provides a flow chart illustrating a method of operating dishwasher appliance according to an exemplary embodiment of the present disclosure.

Turning to FIG. 8, a flow diagram is provided of a method according to an exemplary embodiment of the present disclosure. FIG. 8 illustrates a method 300 of operating a dishwasher appliance (e.g., dishwasher appliance 100). Advantageously, method 300 may improve draining or cleaning performance of an appliance. The method 300 can be performed, for instance, by the controller 137. For example, controller 137 may, as discussed, be operably connected to the recirculation pump 154 and/or drain pump 208, and may send one or more signals to and receive one or more signals from the recirculation pump 154, drain pump 208, control panel 121, and/or sensor 164. Controller 137 may further be in communication with other suitable components of appliance 100 to facilitate operation of the appliance 100 generally. FIG. 8 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure, except as otherwise indicated.

At 310, the method 300 includes directing wash fluid, such as water and/or dishwasher fluid, to the wash chamber within the appliance. For instance, water may be introduced to a wash tub through one or more supply valves or diverters. The valves or diverters may be positioned within a sump portion of the tub such that wash fluid is directed to the sump portion. In some embodiments, 310 occurs as part of an exemplary wash cycle configured to wash one or more items (e.g., dishes) within a wash chamber. Optionally, wash fluid may be recirculated through one or more spray assemblies that direct wash fluid into a wash chamber portion of wash tub, e.g., from the sump portion of the wash tub. In some such embodiments, 310 includes activating the recirculation pump to flow wash fluid through a coarse filter in a primary flow direction. After being directed into the wash chamber, wash fluid flows to the sump portion through the coarse filter, before being received by the recirculation pump and motivated through fluid circulation assembly. From the fluid circulation assembly, wash fluid may be directed toward one or more spray assemblies. In certain embodiments, 310 may include deactivating a drain pump for the duration of the wash cycle.

At 320, the method 300 includes activating the recirculation pump to flow wash fluid through the coarse filter in the primary flow direction for or during an initial purge cycle. If the immediately preceding step requires activation of the recirculation pump, 320 may include maintaining the recirculation pump in an active state to continue to flow wash fluid through the coarse filter. Operation of the recirculation pump may be continuous. At 320, wash fluid flows to the sump portion through the coarse filter as described above, before being received by the recirculation pump and motivated through fluid circulation assembly toward one or more spray assemblies. Optionally, a portion of wash fluid flowed through the coarse filter may pass through an internal chamber of a fine filter. For instance, wash fluid may pass through an opening defined above fine filter, or wash fluid may pass through one or more media openings defined by the coarse filter.

At 330, the method 300 includes activating the drain pump to flow wash fluid through the coarse filter in the primary flow direction for or during the initial purge cycle. Optionally, 330 may occur simultaneously with 320. For instance, both the recirculation pump and the drain pump may be activated for the span of the initial purge cycle. In alternative embodiments, 330 may be initiated immediately prior to 320. In some embodiments, the initial purge cycle may occur for a predetermined time limit before ending. Optionally, the predetermined time limit may be within a time range between about 2 and about 20 seconds.

At 340, the method 300 includes flushing wash fluid through the coarse filter and into the tub in a secondary flow direction. As described above, the secondary flow direction may be in the generally opposite direction from the primary flow direction. At 340, wash fluid may rise from the sump, through the coarse filter and to a level thereabove. Wash fluid may be directed, for instance, from an elevated spray assembly. Optionally, 340 may occur after initial purge cycle has ended, such as immediately after as a next subsequent step. In some embodiments, 340 includes deactivating the recirculation pump for a set rinsing cycle. The drain pump may be deactivated, e.g., simultaneously with recirculation pump, for the set rinsing cycle. For instance, 340 may include deactivating both the recirculation pump and the drain pump for a predetermined time limit. Optionally, the predetermined time limit may be within a time range between about 2 and about 45 seconds.

At 350, the method 300 includes activating the recirculation pump to flow wash fluid through the coarse filter in the primary flow direction for an additional purge cycle. Optionally, the additional purge cycle may occur after the initial purge cycle and/or flushing (e.g., rinsing cycle), such as immediately after as a next subsequent step. At 350, wash fluid flows to the sump portion through the coarse filter as described above, before being received by the recirculation pump and motivated through fluid circulation assembly toward one or more spray assemblies. Optionally, a portion of wash fluid flowed through the coarse filter may pass through an internal chamber of a fine filter. For instance, wash fluid may pass through an opening defined above fine filter, or wash fluid may pass through one or more media openings defined by the coarse filter.

At 360, the method 300 includes activating the drain pump to flow wash fluid through the coarse filter in the primary flow direction for the additional purge cycle. Optionally, 360 may occur simultaneously with 350. For instance, both the recirculation pump and the drain pump may be activated for the span of an additional purge cycle. In alternative embodiments, 360 may be initiated immediately prior to 350. The additional purge cycle may occur for a predetermined time limit before ending. Optionally, the predetermined time limit may be within a time range between about 2 and about 20 seconds.

In some embodiments, 300 includes a wash chamber drain cycle. For instance, in exemplary embodiments, the wash chamber drain cycle occurs after an additional purge cycle has ended, such as immediately after as a next subsequent step. During the drain cycle, the drain pump is activated to flow wash fluid from the sump portion of the tub, through an exit conduit, and to a drain outlet. Optionally, the recirculation pump may be deactivated such wash fluid flows exclusively through the exit conduit from the sump. The drain cycle may occur after the rinsing cycle and/or additional purge cycle. If the immediately preceding step required activation of the drain pump, drain cycle may include maintaining the drain pump in an active state to continue to flow wash fluid through the exit conduit.

Figure 9:
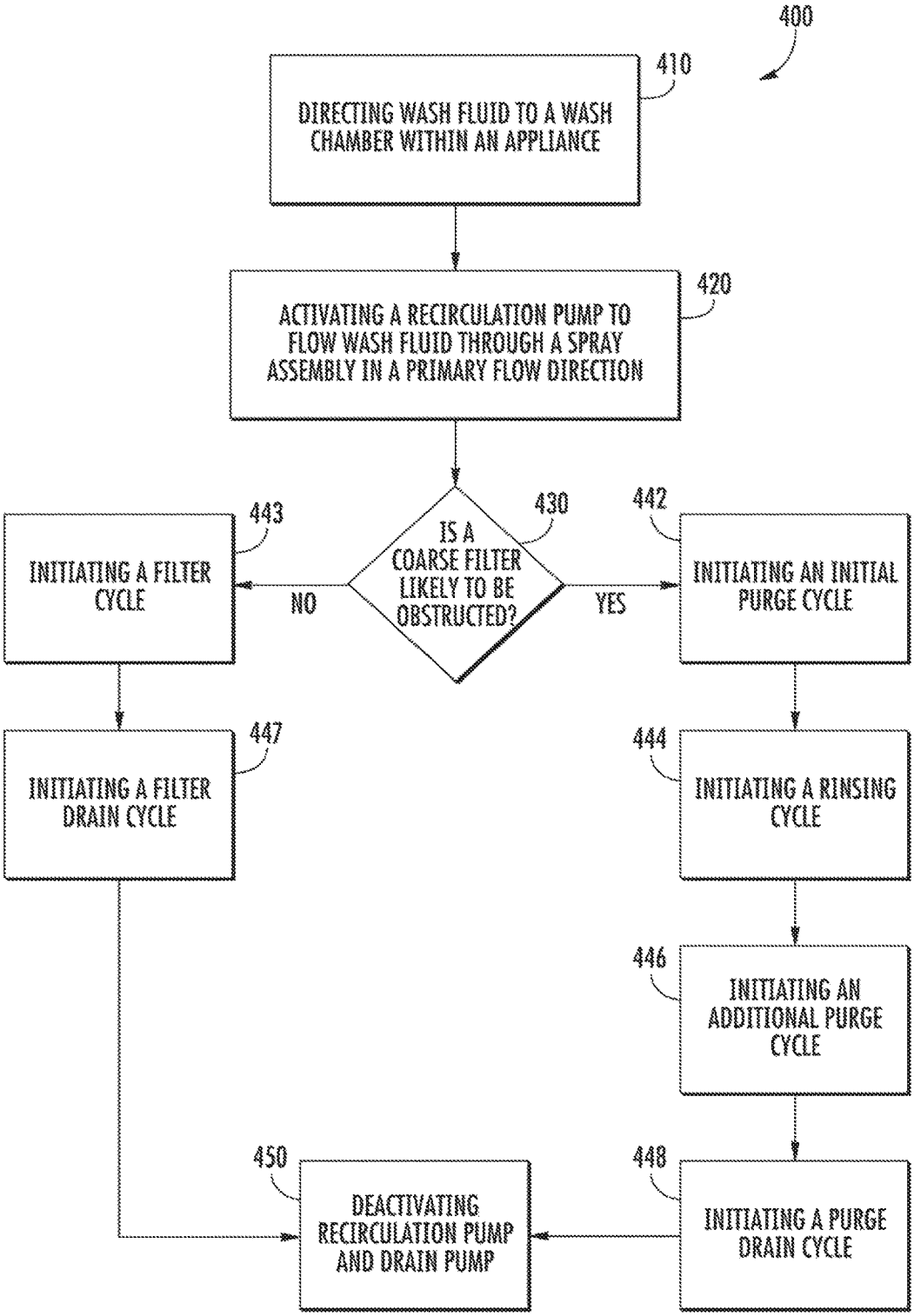
FIG. 9 provides a flow chart illustrating another method of operating dishwasher appliance according to an exemplary embodiment of the present disclosure.

Turning to FIG. 9, a flow diagram is provided of another method according to an exemplary embodiment of the present disclosure. FIG. 9 illustrates a method 400 of operating a dishwasher appliance (e.g., dishwasher appliance 100). Advantageously, method 400 may improve draining and cleaning performance of an appliance. The method 400 can be performed, for instance, by the controller 137. For example, controller 137 may, as discussed, be operably connected to recirculation pump and/or drain pump 208, and may send one or more signals to and receive one or more signals from the recirculation pump 154, drain pump 208, control panel 121, and/or sensor 164. Controller 137 may further be in communication with other suitable components of appliance 100 to facilitate operation of the appliance 100 generally. FIG. 9 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure, except as otherwise indicated.

At 410, the method 400 includes directing wash fluid, such as water and/or dishwasher fluid, to the wash chamber within the appliance. For instance, water may be introduced to a wash tub through one or more supply valves or diverters. The valves or diverters may be positioned within a sump portion of the tub such that wash fluid is directed to the sump portion. In some embodiments, 410 occurs as part of an exemplary wash cycle configured to wash one or more items (e.g., dishes) within a wash chamber. Optionally, wash fluid may be recirculated through one or more spray assemblies that direct wash fluid into a wash chamber portion of wash tub, e.g., from the sump portion of the wash tub.

At 420, the method 400 includes activating a recirculation pump to flow wash fluid through a spray assembly in a primary flow direction, e.g., in fluid series from a wash chamber to a recessed portion of a tub. In some embodiments, wash fluid flows to a sump portion of the wash tub through a coarse filter, before being received by the recirculation pump. From the recirculation pump, wash fluid is motivated through one or more spray assemblies. Optionally, 420 is included as part of a wash cycle following 410, such as immediately after as a next subsequent step. In certain embodiments, 420 may include deactivating a drain pump for the duration of the wash cycle.

At 430, the method 400 includes evaluating whether the coarse filter is likely to be obstructed, e.g., from the accumulation of debris or particles thereon. For instance, 430 may include determining the number of cycles, e.g., wash cycles, performed since another cycle, e.g., purge cycle, has been performed. In some embodiments, 430 may include receiving a specific user input, e.g., from a control panel. Additionally or alternatively, 430 may include monitoring wash fluid within the appliance. In some such embodiments, 430 includes determining condition of wash fluid flowing through the one or more spray assemblies, such as water turbidity. Turbidity signals may be received, for instance, from a turbidity sensor disposed along a spray assembly in fluid communication with the recirculation pump. A received turbidity signal may be evaluated as a turbidity value and compared to set limit provided to a controller—e.g., as a preset value, a lookup table, or an algorithm. Determination of a turbidity level above a set limit (e.g., range) may indicate that the coarse filter is likely to be dirty or obstructed. Determination of a turbidity level below a set limit (e.g., range) may indicate that the coarse filter is not likely to be obstructed. Based on whether the coarse filter likely to be obstructed, the method 400 may proceed to a unique appliance cycle as part of a first step set (e.g., 442, 444, 446, 448, 450) or a second step set (e.g., 443, 447, 450).

If the coarse filter is likely to be obstructed, as determined at 430, an initial purge cycle may be initiated at 442. In some embodiments, 442 includes activating the recirculation pump to flow wash fluid through the coarse filter in the primary flow direction. Optionally, 442 may include maintaining the recirculation pump in an active state to flow wash fluid through the coarse filter. Operation of the recirculation pump may be continuous from 420 to 442. At 442, wash fluid flows to the sump portion through the coarse filter as described above, before being received by the recirculation pump and motivated toward one or more spray assemblies. Optionally, a portion of wash fluid flowed through the coarse filter may pass through an internal chamber of a fine filter.

For instance, wash fluid may pass through an opening defined above fine filter, or wash fluid may pass through one or more media openings defined by the coarse filter.

In certain embodiments, 442 includes activating a drain pump to flow wash fluid through the coarse filter in the primary flow direction. The drain pump may be activated separate from or simultaneously with the recirculation pump. Optionally, both the recirculation pump and the drain pump may be activated for the span of the initial purge cycle. In some embodiments, 442 occurs for a predetermined time limit before ending. The predetermined time limit may be within a time range between about 2 and about 20 seconds.

At 444, the method 400 includes initiating a rinsing cycle. In some embodiments, 444 occurs only after 444 has completed, such as immediately after as a next subsequent step. In optional embodiments, 444 includes flushing wash fluid through the coarse filter and into the tub in a secondary flow direction. As described above, the secondary flow direction may be in the generally opposite direction from the primary flow direction. Wash fluid may rise from the sump, through the coarse filter and to a level thereabove. Wash fluid may be directed, for instance, from an elevated spray assembly, advantageously reducing net water use for the appliance. In additional or alternative embodiments, 444 includes deactivating the recirculation pump for a set rinsing cycle. The drain pump may be further deactivated, e.g., simultaneously with recirculation pump. For instance, 444 may include deactivating both the recirculation pump and the drain pump for a predetermined time limit that spans the rinsing cycle. Optionally, the predetermined time limit may be within a time range between about 2 and about 45 seconds.

At 446, the method 400 includes initiating an additional purge cycle. In some embodiments, 446 includes activating the recirculation pump to flow wash fluid through the coarse filter in the primary flow direction. At 446, wash fluid flows to the sump portion through the coarse filter, as described above, before being received by the recirculation pump and motivated toward one or more spray assemblies. Optionally, a portion of wash fluid flowed through the coarse filter may pass through an internal chamber of a fine filter. For instance, wash fluid may pass through an opening defined above fine filter, or wash fluid may pass through one or more media openings defined by the coarse filter.

In certain embodiments, 446 includes activating a drain pump to flow wash fluid through the coarse filter in the primary flow direction. The drain pump may be activated separate from or simultaneously with the recirculation pump. Optionally, both the recirculation pump and the drain pump may be activated for the span of the additional purge cycle. In some embodiments, 446 occurs for a predetermined time limit before ending. The predetermined time limit may be within a time range between about 2 and about 20 seconds.

At 448, method 400 includes initiating a purge drain cycle. In some embodiments, the purge drain cycle may follow one or more additional purge cycles, e.g., 446, such as immediately after as a next subsequent step. At 448, the drain pump is activated to flow wash fluid from the sump portion of the wash tub, through an exit conduit, and to a drain outlet. Optionally, 448 may include maintaining the recirculation pump in an active state to flow wash fluid through the coarse filter. Operation of the drain pump may be continuous from 446 to 448. At 448, the drain pump may be activated for a predetermined time period. For instance, the predetermined time period may be between 5 seconds to 2 min. In certain embodiments, the predetermined time period may be about 15 seconds. Optionally, the recirculation pump may be deactivated such wash fluid flows exclusively through the exit conduit from the sump. At 450, the method 400 includes deactivating the drain pump and the recirculation pump, e.g., such that wash fluid flow is halted within appliance.

Returning to 430, if the coarse filter is not likely to be obstructed, a filter cycle may be initiated at 443. In some embodiments, 443 includes activating the recirculation pump to flow wash fluid through the coarse filter in the primary flow direction. Optionally, 443 may include maintaining the recirculation pump in an active state to flow wash fluid through the coarse filter. Operation of the recirculation pump may be continuous from 420 to 443. At 443, wash fluid flows to the sump portion through the coarse filter as described above, before being received by the recirculation pump and motivated toward one or more spray assemblies. A portion of wash fluid flowed through the coarse filter may pass through an internal chamber of a fine filter. For instance, wash fluid may pass through an opening defined above fine filter, or wash fluid may pass through one or more media openings defined by the coarse filter.

At 443, the method 400 includes activating the drain pump to flow wash fluid through the coarse filter in the primary flow direction. The drain pump is activated simultaneously with the recirculation pump. For instance, both the recirculation pump and the drain pump may be activated for the span of the filter cycle. Optionally, 443 may occur for a predetermined time limit before ending. Optionally, the predetermined time limit may be within a time range between about 2 and about 20 seconds.

At 447, method 400 includes initiating a filter drain cycle. The drain pump is activated to flow wash fluid from the sump portion of the wash tub, through an exit conduit, and to the drain outlet. In some embodiments, 447 occurs after a filter cycle, e.g., 443, such as immediately after as a next subsequent step. Optionally, 447 may include maintaining the recirculation pump in an active state to flow wash fluid through the coarse filter. Operation of the drain pump may be continuous from 443 to 447. At 447, the drain pump may be activated for a predetermined time period. For instance, the predetermined time period may be between 15 seconds to 2 min. In certain embodiments, the predetermined time period may be about 30 seconds. In additional or alternative embodiments, the predetermined time period for 447 is greater than the predetermined time period for 448. Optionally, the recirculation pump may be deactivated such that wash fluid flows exclusively through the exit conduit from the sump. At 450, the method 400 includes deactivating the drain pump and the recirculation pump, e.g., such that wash fluid flow is halted within appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dishwasher appliance, the dishwasher appliance including a tub defining a wash chamber, a coarse filter disposed at a bottom portion of the tub, a recirculation pump downstream from the coarse filter in a primary flow direction, and a drain pump downstream from the coarse filter in the primary flow direction, the method comprising:

directing wash fluid to the tub within the appliance;

activating the recirculation pump to flow wash fluid through the coarse filter in the primary flow direction for an initial purge cycle;

activating the drain pump to flow wash fluid through the coarse filter in the primary flow direction for the initial purge cycle;

flushing wash fluid through the coarse filter and into the tub in a secondary flow direction, the secondary flow direction being opposite from the primary flow direction;

activating the recirculation pump to flow wash fluid through the coarse filter in the primary flow direction for an additional purge cycle; and activating the drain pump to flow wash fluid through the coarse filter in the primary flow direction for the additional purge cycle.

2. The method of claim 1, wherein flushing wash fluid includes deactivating the recirculation pump for a set rinsing cycle, and deactivating the drain pump for the set rinsing cycle.

3. The method of claim 1, wherein flushing wash fluid includes directing wash fluid to the coarse filter in the second flow direction from a spray assembly located above a rack of the dishwasher appliance.

4. The method of claim 1, further comprising:

activating the drain pump to flow wash fluid through the coarse filter in the primary flow direction for a drain cycle; and deactivating the recirculation pump for the drain cycle.

5. The method of claim 1, further comprising:

activating the recirculation pump to flow wash fluid through the coarse filter in the primary flow direction for a wash cycle; and deactivating the drain pump for the wash cycle.

6. The method of claim 1, wherein the initial purge cycle occurs for a predetermined time limit of between 2 and 20 seconds.

7. The method of claim 1, flushing wash fluid includes deactivating the recirculation pump and the drain pump for a predetermined time limit between 2 and 45 seconds.

8. The method of claim 1, wherein activating the recirculation pump for the initial purge cycle and activating the drain pump for the initial purge cycle occurs simultaneously before flushing wash fluid, and wherein activating the recirculation pump for the additional purge cycle and activating the drain pump for the additional purge cycle occurs simultaneously after flushing wash fluid.

9. The method of claim 5, further comprising:

determining a condition of wash fluid flowing through the recirculation pump during the wash cycle; and selecting an appliance cycle based on the determined condition of wash fluid.

10. The method of claim 9, wherein the condition is water turbidity.

11. A method of operating a dishwasher appliance, the dishwasher appliance including a tub defining a wash chamber, a coarse filter disposed at a bottom portion of the tub, a recirculation pump downstream from the coarse filter in a primary flow direction, a drain pump downstream from the coarse filter in the primary flow direction, and a spray assembly in fluid communication with the recirculation pump, the spray assembly being disposed downstream from the recirculation pump in the primary flow direction, the method comprising:

directing wash fluid to the tub within the appliance;

activating the recirculation pump to flow wash fluid through the coarse filter in the primary flow direction for an initial purge cycle;

activating the drain pump to flow wash fluid through the coarse filter in the primary flow direction for the initial purge cycle;

flushing wash fluid through the coarse filter and into the tub in a secondary flow direction from the spray assembly, the secondary flow direction being opposite from the primary flow direction;

activating the recirculation pump to flow wash fluid through the coarse filter in the primary flow direction for an additional purge cycle; and activating the drain pump to flow wash fluid through the coarse filter in the primary flow direction for the additional purge cycle.

12. The method of claim 11, wherein flushing wash fluid includes deactivating the recirculation pump for a set rinsing cycle, and deactivating the drain pump for the set rinsing cycle.

13. The method of claim 11, wherein the tub defines a sump between the coarse filter and the recirculation pump, and wherein flushing wash fluid includes filling the sump with wash fluid from the spray assembly.

14. The method of claim 11, further comprising:

activating the drain pump to flow wash fluid through the coarse filter in the primary flow direction for a drain cycle; and deactivating the recirculation pump for the drain cycle.

15. The method of claim 11, further comprising:

activating the recirculation pump to flow wash fluid through the coarse filter in the primary flow direction for a wash cycle; and deactivating the drain pump for the wash cycle.

16. The method of claim 11, further comprising:

determining a condition of wash fluid within the appliance; and initiating the initial purge cycle based on the determined condition of wash fluid within the appliance.

17. The method of claim 16, wherein the condition is water turbidity.

18. The method of claim 11, wherein the initial purge cycle is defined by a predetermined time limit between 2 and 20 seconds.

19. The method of claim 11, wherein flushing includes deactivating the recirculation pump and the drain pump for a predetermined time limit between 2 and 45 seconds.

20. The method of claim 11, wherein activating the recirculation pump for the initial purge cycle and activating the drain pump for the initial purge cycle occurs simultaneously before flushing wash fluid, and wherein activating the recirculation pump for the additional purge cycle and activating the drain pump for the additional purge cycle occurs simultaneously after flushing wash fluid.

* * * * *